US008710341B2

(12) United States Patent
Bowen

(10) Patent No.: US 8,710,341 B2
(45) Date of Patent: Apr. 29, 2014

(54) GUITAR STRAP ATTACHMENT MEANS

(76) Inventor: Joseph Anthony Bowen, Boiling Springs, SC (US)

( * ) Notice: Subject to any disclaimer, the term of this patent is extended or adjusted under 35 U.S.C. 154(b) by 1291 days.

(21) Appl. No.: 12/313,770

(22) Filed: Nov. 24, 2008

(65) Prior Publication Data

US 2010/0126329 A1 May 27, 2010

(51) Int. Cl.
*G10D 3/00* (2006.01)

(52) U.S. Cl.
USPC ..... 84/327

(58) Field of Classification Search
USPC ..... 84/290, 327, 329
See application file for complete search history.

(56) References Cited

U.S. PATENT DOCUMENTS

| | | | | |
|---|---|---|---|---|
| 3,935,782 | A * | 2/1976 | O'Brien | 84/743 |
| 5,689,082 | A | 11/1997 | Youngblood | 84/743 |
| 6,855,879 | B2 | 2/2005 | Minakuchi et al. | 84/327 |
| 7,060,889 | B2 * | 6/2006 | Bellak | 84/741 |
| 7,358,430 | B2 | 4/2008 | Tambara | 84/327 |
| 2006/0081112 | A1 | 4/2006 | Gipson | 84/327 |
| 2006/0278059 | A1 | 12/2006 | Gipson | 84/302 |

* cited by examiner

*Primary Examiner* — Kimberly Lockett
(74) *Attorney, Agent, or Firm* — Southeast IP Group; Thomas Moses

(57) ABSTRACT

A guitar strap attachment means (also called the "strap plug" herein) preferably comprises two main components that are integrally formed together. A shaft member, in a preferred embodiment is generally the same size and shape of the shaft of a TRS (tip, ring, sleeve) connector that is typically plugged into the electric audio jack. The shaft member is cylindrical in nature, and includes a tip, a ring and a sleeve portion. A head member is attached to the end of the sleeve (on the end opposite the tip), and in a preferred embodiment is enlarged and round in shape. The shaft member extends in axial relation from the center of the head member. The strap plug may be made of plastic or any other suitable material.

In use, the shaft member is run through the end loop of a guitar strap, and the strap plug is then inserted into the electric audio jack of the guitar. The head member serves to hold the loop in place so that the guitar does not accidentally become detached from the guitar strap. Additionally, the strap plug may be inserted into the electric audio jack when the guitar is not in use or in storage, to protect the jack against dirt, dust and trash from entering the jack hole, and further to protect the exterior portion of the jack against abrasion and related damage.

10 Claims, 2 Drawing Sheets

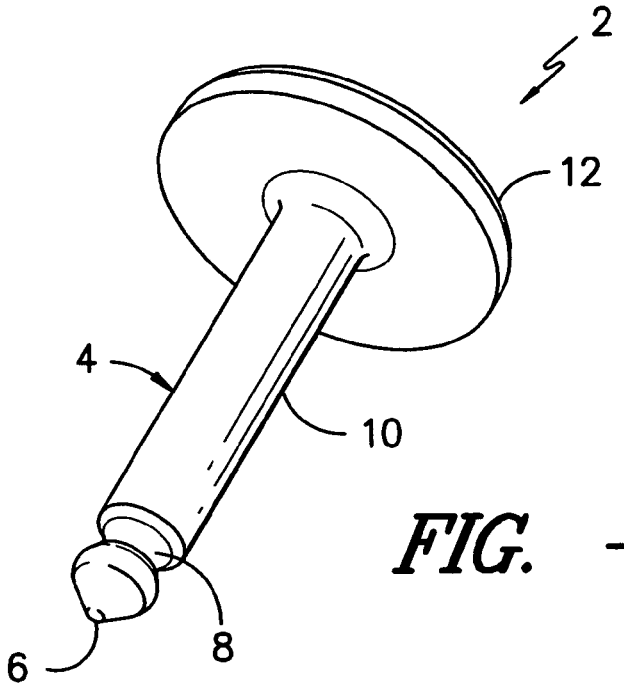
FIG. –1–
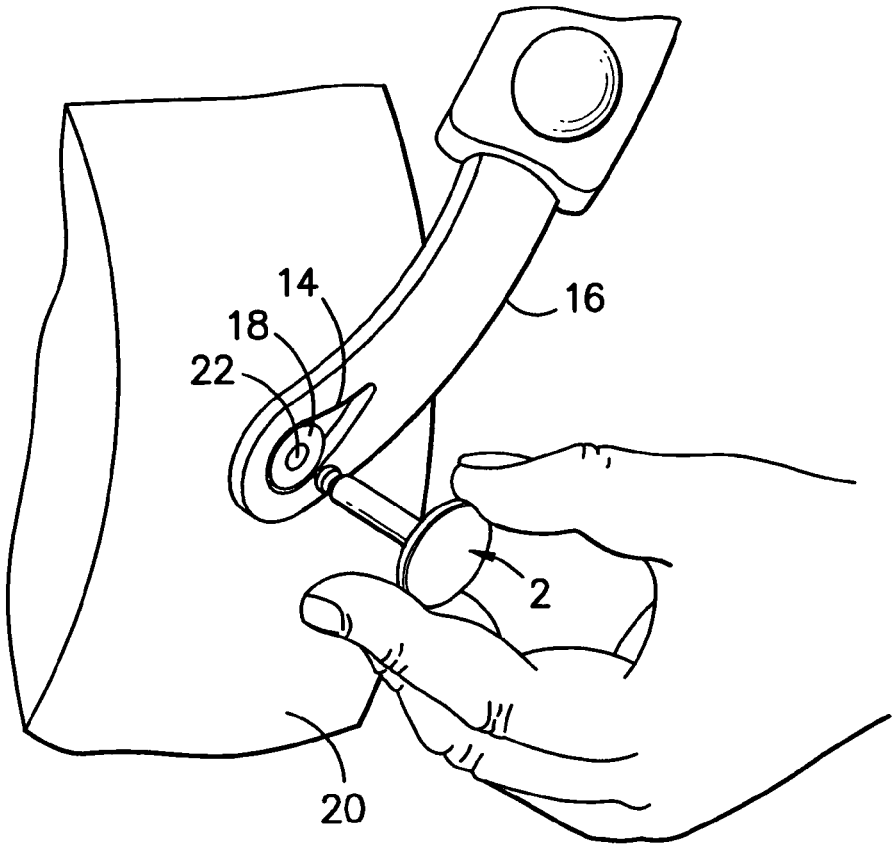
FIG. –2–

GUITAR STRAP ATTACHMENT MEANS

BACKGROUND OF THE INVENTION

The present invention relates generally to means for attaching a guitar strap to a guitar having an electric audio jack. More specifically, the invention relates to a plug having a head member and a round shaft suitable for insertion into an electric audio jack of a guitar.

Acoustic electric guitars are typically acoustic guitars that are fitted with pickups, a microphone, or transducers. They are also referred to as "plug-in acoustic guitars", due to their ability to simply "plug in" to a speaker system without the need for microphones. Typically, the acoustic electric guitars have the appearance of acoustic guitars, but also have an electric audio jack located on the body of the guitar on the opposite side from the neck of the guitar. Acoustic electric guitars may be played in either the acoustic mode (unplugged from any electrical speaker or amplifier system), or in the electric mode (plugged into an electrical speaker or amplifier system).

Typically, acoustic electric guitars have straps that attach at one point on the neck of the guitar by known means, and also attach to the body of the guitar by means of a loop. When a cord is plugged into the guitar (in the electric mode), the plug is first passed through the loop of the guitar strap, and is then plugged into the electric audio jack of the guitar. In this configuration, the electrical plug ensures that if the strap becomes dislodged from the jack, the guitar will not fall to the floor. However, when the guitar is being played in the acoustic mode, and the electrical plug is not in use, the loop of the guitar strap is often placed over and around the jack itself. The problem with this configuration is that the guitar strap loop tends to slide off of the jack while the guitar is in use, creating the danger that the guitar will accidentally fall to the floor, thus causing damage to the guitar and embarrassment to the musician.

Heretofore, many different devices have been used to attach a guitar strap to a guitar. Some of these strap attachments include screws that are inserted into the body of the guitar. It is generally undesirable to drill or create a hole in the body of an acoustic guitar, due to the negative effect that the hole produces in the sound quality of the music. Further, additional holes in the body of the guitar tend to diminish the value of the instrument. Therefore, it would be desirable to provide a guitar strap attachment means that avoids the necessity of using a screw or other method that requires a hole to be drilled or created within the body of the guitar.

Other devices exist for the purpose of attaching guitar straps to guitars. Some of these devices are modified electric audio jacks that have an expanded lip around the exposed portion of the jack member that holds the guitar strap in place, with the addition of a circular clip, as shown in U.S. Pat. No. 3,935,782. Examples of other types of attachment means are disclosed in U.S. Pat. Nos. 6,855,879 and 7,358,430, as well as U.S. patent application Ser. Nos. 11/445,725 and 11/250,929.

None of the devices used heretofore, however, are designed simply to fit into a standard electrical audio jack of a guitar and hold the guitar strap in place.

OBJECTS OF THE INVENTION

Therefore, it is an object of the present invention to provide a plug having a rounded shaft member that fits through the loop at the end of a guitar strap and into a standard electric audio jack of a guitar, wherein the plug also includes an enlarged head for holding the loop and the strap in place on the guitar.

It is another object of the present invention to provide means for attaching a guitar strap to a guitar without the necessity of drilling or creating an additional hole in the body of the guitar.

It is yet another object of the present invention to provide a device for attaching a guitar strap to a guitar that is inexpensive to manufacture, compact, and easy to use.

It is still another object of the present invention to provide guitar strap attachment means that protect the electric audio jack by preventing dirt, dust, liquids or other trash from entering the hole within the jack, and also by preventing damage to the electric audio jack itself when the jack is not in use, or when the guitar is being stored.

Another important object of the present invention is to provide a guitar strap attachment means that overcomes some of the disadvantages of the devices currently and formerly used in the market.

SUMMARY OF THE INVENTION

In a preferred embodiment, the guitar strap attachment means (also called the "strap plug" herein) comprises two main components that are integrally formed together. A shaft member, in a preferred embodiment is generally the same size and shape of the shaft of a TRS (tip, ring, sleeve) connector that is typically plugged into the electric audio jack. The shaft member is cylindrical in nature, and includes a tip, a ring and a sleeve portion. A head member is attached to the end of the sleeve (on the end opposite the tip), and in a preferred embodiment is enlarged and round in shape. The shaft member extends in axial relation from the center of the head member. The strap plug may be made of plastic or any other suitable material.

In use, the shaft member is run through the end loop of a guitar strap, and the strap plug is then inserted into the electric audio jack of the guitar. The head member serves to hold the loop in place so that the guitar does not accidentally become detached from the guitar strap. Additionally, the strap plug may be inserted into the electric audio jack when the guitar is not in use or in storage, to protect the jack against dirt, dust and trash from entering the jack hole, and further to protect the exterior portion of the jack against abrasion and related damage.

BRIEF DESCRIPTION OF THE DRAWINGS

These and other features, aspects, and advantages of the present invention will become better understood with regard to the following description, appended claims, and accompanying drawings where:

FIG. 1 is a perspective drawing of one embodiment of the strap plug, showing the head member attached to the shaft member;

FIG. 2 is a perspective view of one embodiment of the strap plug being inserted through the end loop of a guitar strap and into the electric audio jack of a guitar;

DETAILED DESCRIPTION OF THE INVENTION

Figure 3:
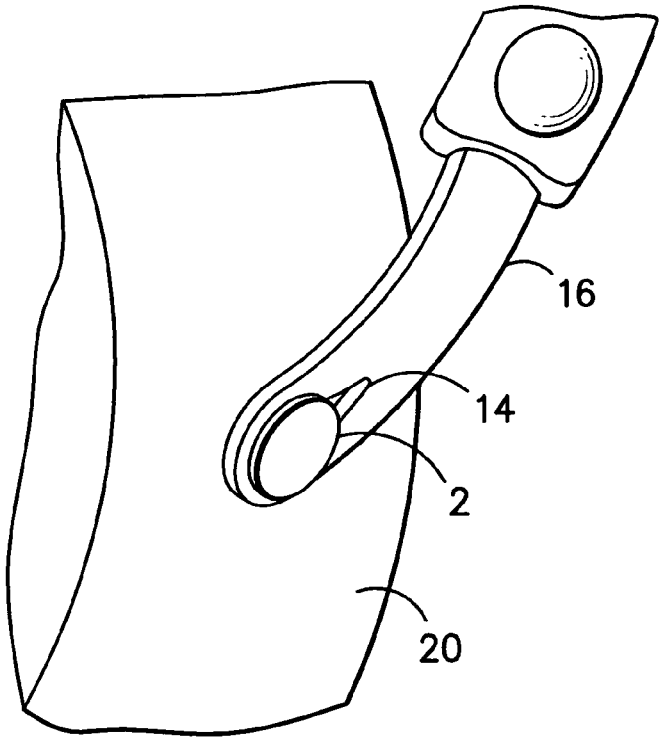
FIG. 3 is a perspective view of one embodiment of the strap plug positioned within the jack plug, wherein the head member is securing the end loop of the guitar strap against the guitar.
Figure 4:
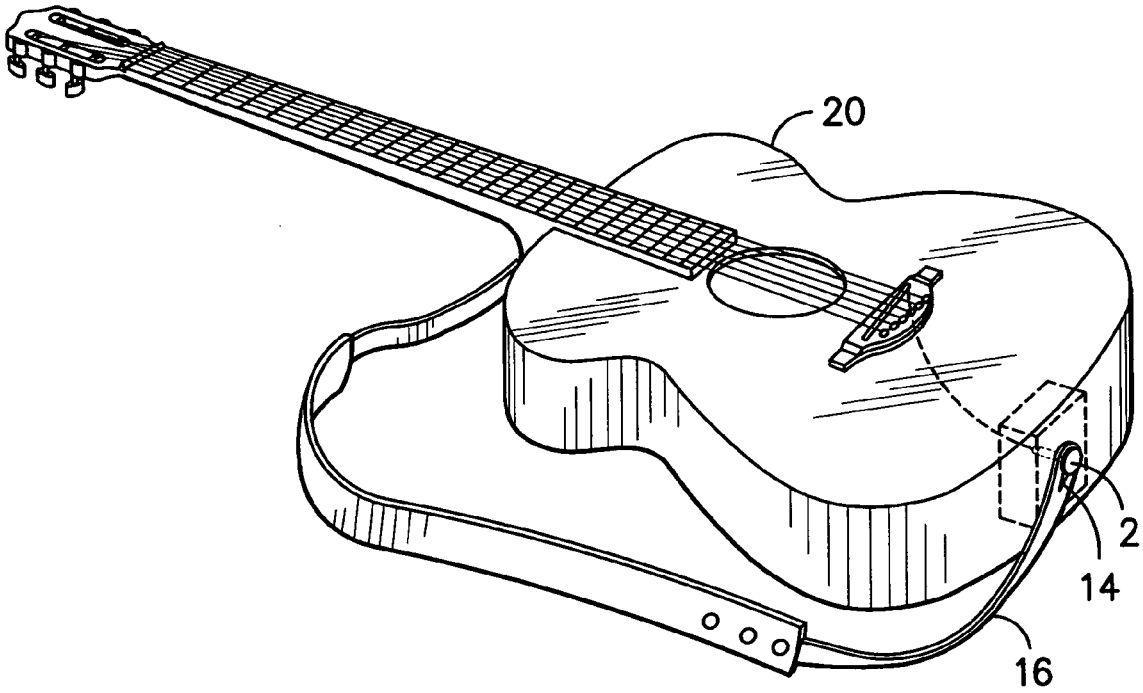
FIG. 4 is a perspective view of a guitar having a strap attached to the body of the guitar with one embodiment of the strap plug.

A first embodiment of the strap plug 2 is shown in FIG. 1. In a preferred embodiment, the strap plug 2 comprises two main components that are integrally formed together. A shaft member 4, in a preferred embodiment, is generally the same size and shape of the shaft of a TRS (tip, ring, sleeve) connector that is typically plugged into the electric audio jack. The shaft member is cylindrical in nature, and includes a tip 6, a ring 8, and a sleeve 10 portion. A head member 12 is attached to the end of the sleeve 10 (on the end opposite the tip 6), and in a preferred embodiment is enlarged and round in shape. The shaft member 4 extends in axial relation from the center of the head member 12.

The strap plug 2 may be made of plastic or any other suitable material. Preferably, the strap plug 2 is integrally formed, and may be made by injection molding or any other suitable process.

The strap plug 2 is used when the guitar 20 is being played in the acoustic mode, in order to hold the guitar strap 16 in place against the body of the guitar 20 when the electric connector to an amplifier or speaker system is not plugged into the jack 18.

In use, the shaft member 4 is run through the end loop 14 of a guitar strap 16, and the strap plug 2 is then inserted into the electric audio jack 18 of the guitar 20. The head member 12 serves to hold the loop 14 in place so that the guitar 20 does not accidentally become detached from the guitar strap 16. Additionally, the strap plug 2 may be inserted into the electric audio jack 18 when the guitar 20 is not in use or in storage, to protect the jack 18 against dirt, dust and trash from entering the jack hole 22, and further to protect the exterior portion of the jack 18 against abrasion and related damage. When not in use, the strap plug 2 may be easily removed from the jack 18 and stored in a compact area.

This arrangement provides an inexpensive means for attaching a guitar strap 16 to a guitar 20 having an electrical audio jack 18, without the necessity of drilling or creating an additional hole in the body of the guitar 20. The strap plug 2 prevents the loop 14 of the guitar strap 16 from becoming dislodged while the guitar 20 is in use in acoustic mode, thus reducing the danger that the guitar 20 will accidentally fall to the floor and cause damage to the guitar 20 and embarrassment to the musician. Further, the strap plug 2 protects the interior and exterior of the jack 18 from damage.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A guitar strap plug for attaching a guitar strap to a guitar, said strap plug comprising:

a shaft member;

a head member attached to one end of said shaft member so that said shaft member extends outwardly from said head member in axial relation;

wherein said strap plug is made of plastic; and wherein said guitar strap plug is formed so that it may be secured within an electrical audio jack outlet that is positioned on an outer portion of a guitar.

2. The guitar strap plug set forth in claim 1, wherein said shaft member includes a sleeve portion, a ring portion, and a tip.

3. The guitar strap plug set forth in claim 1, wherein said head member is generally round in shape.

4. The guitar strap plug set forth in claim 1, wherein said shaft member and said head member are integrally formed.

5. A method of attaching a guitar strap to an electric audio jack of a guitar, said method comprising the steps of:

providing a guitar strap plug having a head member and a shaft member;

positioning said shaft member through a loop at one end of a guitar strap and then inserting said shaft member into an electric audio jack of a guitar.

6. The method set forth in claim 5, wherein said strap plug is made of plastic.

7. The method set forth in claim 5, wherein said shaft member is generally cylindrical and said head member is generally round in shape.

8. The method set forth in claim 5, wherein said shaft member includes a sleeve portion, a ring portion, and a tip.

9. The method set forth in claim 5, wherein said head member is attached to one end of said shaft member so that said shaft member extends outwardly from said head member in axial relation.

10. The method set forth in claim 5, wherein said shaft member and said head member are integrally formed.

* * * * *